US008555437B2

(12) United States Patent
Gorovitz

(10) Patent No.: US 8,555,437 B2
(45) Date of Patent: Oct. 15, 2013

(54) MASSAGE TABLE WITH COMFORT FEATURE

(76) Inventor: Marvin Gorovitz, Philadelphia, PA (US)

( * ) Notice: Subject to any disclaimer, the term of this patent is extended or adjusted under 35 U.S.C. 154(b) by 88 days.

(21) Appl. No.: 12/806,914

(22) Filed: Aug. 24, 2010

(65) Prior Publication Data

US 2011/0047705 A1 Mar. 3, 2011

Related U.S. Application Data

(60) Provisional application No. 61/275,289, filed on Aug. 27, 2009.

(51) Int. Cl.
*A47B 7/00* (2006.01)
*A47B 7/02* (2006.01)

(52) U.S. Cl.
USPC ..... 5/613; 5/735; 5/930; 5/631; 5/620; 5/622

(58) Field of Classification Search
USPC ..... 5/735, 930, 631, 620, 622, 613; 108/25–26, 90, 166–169, 173–174
See application file for complete search history.

(56) References Cited

U.S. PATENT DOCUMENTS

| | | | | | |
|---|---|---|---|---|---|
| 1,194,112 | A | * | 8/1916 | Wood et al. | 5/613 |
| 1,499,013 | A | * | 6/1924 | Gunther | 5/613 |
| 1,971,624 | A | * | 8/1934 | Rusk | 5/636 |
| 2,228,793 | A | * | 1/1941 | Swofford | 5/613 |
| 2,579,783 | A | * | 12/1951 | Branto | 5/617 |
| 2,872,259 | A | * | 2/1959 | Thorpe | 5/613 |
| 4,333,638 | A | * | 6/1982 | Gillotti | 5/613 |
| 4,596,384 | A | * | 6/1986 | Blosser | 5/613 |
| D295,349 | S | * | 4/1988 | Mueller | D6/429 |
| 4,882,797 | A | * | 11/1989 | Failor et al. | 5/613 |
| 4,943,041 | A | * | 7/1990 | Romein | 5/620 |
| 5,009,170 | A | * | 4/1991 | Spehar | 108/36 |
| 5,233,713 | A | * | 8/1993 | Murphy et al. | 5/636 |
| 5,335,676 | A | * | 8/1994 | O'Brien | 5/620 |
| 5,369,824 | A | * | 12/1994 | Powell | 5/735 |
| 5,400,449 | A | * | 3/1995 | Satto | 5/631 |
| D357,538 | S | * | 4/1995 | Sockwell et al. | 5/631 |
| D364,464 | S | * | 11/1995 | Gigante et al. | D24/183 |
| 5,524,555 | A | * | 6/1996 | Fanuzzi | 108/36 |
| 5,642,542 | A | * | 7/1997 | Kometani | 5/620 |
| 5,652,981 | A | * | 8/1997 | Singer-Leyton et al. | 5/631 |
| D403,772 | S | * | 1/1999 | Fanuzzi | D24/183 |
| 6,000,345 | A | * | 12/1999 | Gillotti | 5/620 |

(Continued)

*Primary Examiner* — Robert G Santos
*Assistant Examiner* — David E Sosnowski
(74) *Attorney, Agent, or Firm* — John F. A. Earley, III; Frank J. Bonini, Jr.; Harding, Earley, Follmer & Frailey, P.C.

(57) ABSTRACT

A massage and chiropractic table having a supporting frame and a surface supported on the frame, and having one or more comfort features, including a recess formed in the surface of the table for accommodating a person's anatomical configuration, such as a woman's breasts, a removable recess insert that may be removed and replaced to expose the recess as desired, a neck recess for facilitating supporting a user's neck in a comfortable position, and a head rest that is configured to reduce or eliminate pressure on a user's face when the user is lying face down on the table. The massage table may be foldable and may have a handle so that it may be readily stored and transported, or, according to other embodiments may be stationary.

15 Claims, 5 Drawing Sheets

(56) References Cited

U.S. PATENT DOCUMENTS

| | | | | |
|---|---|---|---|---|
| 6,052,847 | A * | 4/2000 | Allyn et al. | 5/632 |
| 6,233,768 | B1 * | 5/2001 | Harding | 5/735 |
| 6,295,668 | B1 * | 10/2001 | Nation | 5/110 |
| 6,408,465 | B1 * | 6/2002 | Fleming | 5/620 |
| 6,431,086 | B1 * | 8/2002 | Lloyd | 108/36 |
| 6,460,207 | B1 * | 10/2002 | Papay et al. | 5/640 |
| 6,568,015 | B1 * | 5/2003 | Allen | 5/735 |
| 6,581,229 | B2 * | 6/2003 | Bernstein | 5/722 |
| 6,588,034 | B2 * | 7/2003 | Nation | 5/110 |
| 6,684,426 | B1 * | 2/2004 | Lin et al. | 5/620 |
| 6,705,234 | B1 * | 3/2004 | Miller et al. | 108/36 |
| 6,857,145 | B1 * | 2/2005 | Sikes | 5/110 |
| 6,934,988 | B1 * | 8/2005 | Wetzler et al. | 5/621 |
| 6,938,287 | B1 * | 9/2005 | Mahshie | 5/111 |
| 7,065,816 | B2 * | 6/2006 | McGettigan | 5/731 |
| D533,667 | S * | 12/2006 | Roleder | D24/183 |
| 7,263,733 | B2 * | 9/2007 | Fujita et al. | 5/601 |
| D578,220 | S * | 10/2008 | Ebarb | D24/184 |
| D585,139 | S * | 1/2009 | Andrews | D24/184 |
| 7,603,730 | B2 * | 10/2009 | Zelnik | 5/601 |
| 7,610,863 | B1 * | 11/2009 | Smith-Huebner | 108/36 |
| 7,636,967 | B1 * | 12/2009 | Stokes | 5/620 |
| 7,676,869 | B2 * | 3/2010 | Zelnik et al. | 5/632 |
| 7,694,370 | B1 * | 4/2010 | Lee | 5/632 |
| 7,761,943 | B2 * | 7/2010 | Roleder et al. | 5/622 |
| 7,867,181 | B2 * | 1/2011 | Powell et al. | 602/18 |
| D656,618 | S * | 3/2012 | Gorovitz | D24/183 |
| 8,234,731 | B2 * | 8/2012 | Skripps | 5/622 |
| 2003/0088919 | A1 * | 5/2003 | Lin | 5/620 |
| 2003/0115674 | A1 * | 6/2003 | Heimbrock et al. | 5/617 |
| 2006/0096034 | A1 * | 5/2006 | Tucci | 5/735 |
| 2006/0112490 | A1 * | 6/2006 | Chausse | 5/690 |
| 2006/0253985 | A1 * | 11/2006 | Skripps | 5/622 |
| 2007/0251010 | A1 * | 11/2007 | Lara | 5/620 |
| 2007/0266907 | A1 * | 11/2007 | Roleder | 108/36 |
| 2009/0211584 | A1 * | 8/2009 | Savich | 128/845 |
| 2010/0263125 | A1 * | 10/2010 | Roleder et al. | 5/622 |
| 2010/0299835 | A1 * | 12/2010 | Andrews | 5/620 |
| 2011/0047705 | A1 * | 3/2011 | Gorovitz | 5/613 |

* cited by examiner

MASSAGE TABLE WITH COMFORT FEATURE

CROSS-REFERENCE TO RELATED APPLICATIONS

This application claims priority to U.S. Provisional Application Ser. No. 61/275,289, filed on Aug. 27, 2009, the complete disclosure of which is herein incorporated by reference.

BACKGROUND OF THE INVENTION

1. Field of the Invention

The present invention relates to a massage table having a pocket for accommodating the breasts of a female user and also having features for accommodating at least a portion of the user's face and neck.

2. Brief Description of the Related Art

Many types of massage tables are available for use, including stationary and foldable types. Often, the portability of the massage tables is required because a masseuse or masseur may travel to a client's location, or it may be desirable to collapse the tables, so that the table may be stored at the location where it may be used or a storage location. A massage table generally has a surface on which a person lies down or rests. However, a woman's anatomy may make it uncomfortable for her to lie down on the table. Women may find such tables to be quite uncomfortable to use. When a woman lies face down on the table, her breasts are pressed firmly against the supporting surface of the massage table, and, although the surface may have some padding or support, it generally must be sufficiently firm to support the weight of an individual. In addition, not only women, but also men may find tables to be uncomfortable, particularly, where the individual has a medical device, such as a pacemaker, installed in the chest area. Therefore, the construction of present tables may be uncomfortable for many users, and current massage tables are particularly uncomfortable for women that have larger bust lines, whether natural or surgically enhanced, and men as well.

Currently, there exists a beach chaise that employs a non-supporting pouch for accommodating a female user's breasts.

A need exists for an improved massage table that provides the user with one or more comfort features for accommodating the anatomy of the user.

SUMMARY OF THE INVENTION

It is an object of the present invention to provide an improved table that provides the user with one or more comfort features for accommodating the user's anatomy.

It is another object of the present invention to provide an improved massage table that provides a massage table that may be comfortably used by a woman even when lying face down.

It is another object of the present invention to provide an improved massage table that provides a massage table that may be comfortably used by a woman when lying face down by reducing the pressure at the location where a woman's breasts may lay on the table.

It is another object of the present invention to provide a massage table which has comfort features for accommodating a portion of a person's head or face.

It is a further object of this invention to provide a massage table which may be foldable for transport and storage.

It is another object of this invention, according to an alternate embodiment. to provide a massage table which is a stationary type massage table.

It is another object of the present invention to provide an improved table that may be useful as a chiropractic table.

It is another object of the invention to provide a table top that has one or more comfort features for accommodating a user's anatomy that may be placed on top of an existing frame or table surface.

BRIEF DESCRIPTION OF THE DRAWING FIGURES

DETAILED DESCRIPTION OF THE PREFERRED EMBODIMENTS

Figure 1:
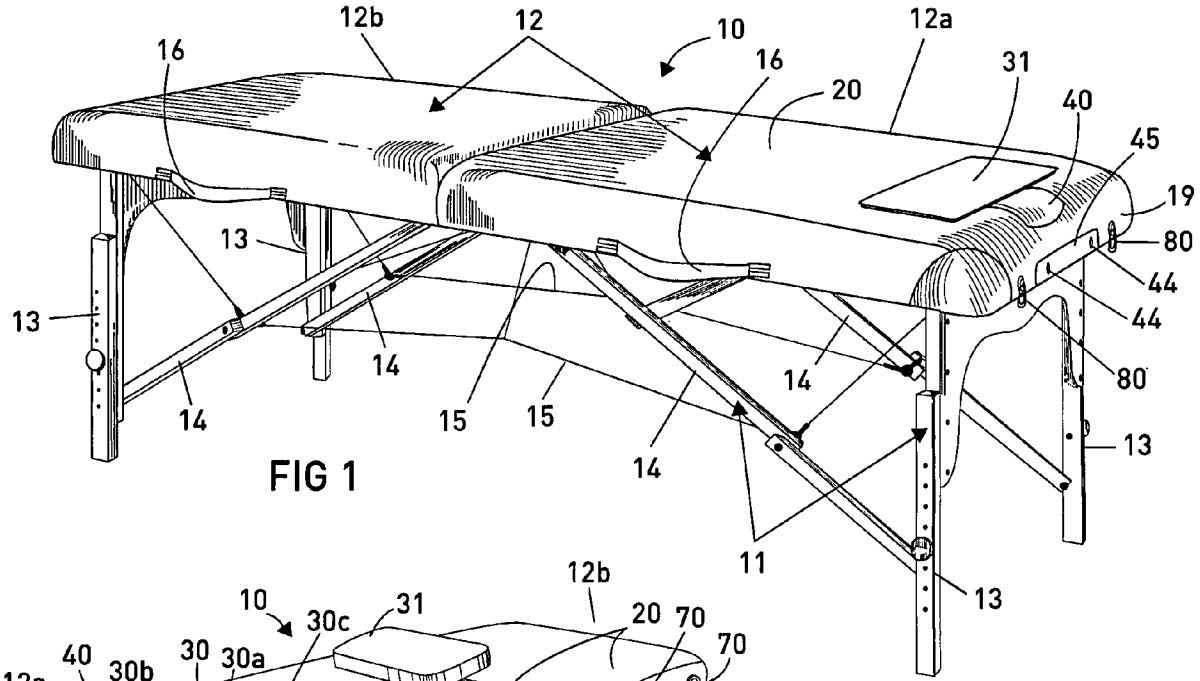
FIG. 1 is a perspective view of a preferred massage table according to my invention as viewed from the front left side, shown with the removable insert installed.

Referring to the drawing FIGS. 1-6, there is illustrated a preferred embodiment of a massage table 10 according to my invention. The massage table 10 is shown having a frame 11 and a top surface 12. Preferably, the frame 11 may be constructed from material which is sturdy and supports the weight of a person. Suitable materials for the frame 11 are steel, aluminum, plastic and wood. The frame 11 preferably is foldable for ease of storage and transporting of the massage table 10. According to an alternate embodiment, the frame and table may be stationary. The frame 11 is shown having adjustable legs 13 so that the height of the table 10 may be positioned at a range of heights. The frame 11 preferably also includes one or more additional support members, such as the frame supports 14 and 15. One or more handles 16 may be provided to facilitate moving the table 10 when it is folded. According to a preferred configuration, the table top surface 12 may be constructed from one or more portions, such as, for example, the two portions 12*a*, 12*b* illustrated in the exemplary embodiment of FIGS. 1-6. The portions 12*a*, 12*b* preferably may be hingeably provided so that the table 10 may be folded to be approximately half of its opened or unfolded length.

The top surface 12 preferably may be constructed from a planar member, such as, for example, a board made of wood, plastic or metal, and covered with padding and a surface cover of leather, vinyl or other suitable surface. The surface cover 20 preferably may be washable, and itself may be further covered with a washable or disposable cover, such as the removable cover 21 shown in FIG. 6.

Figure 2:
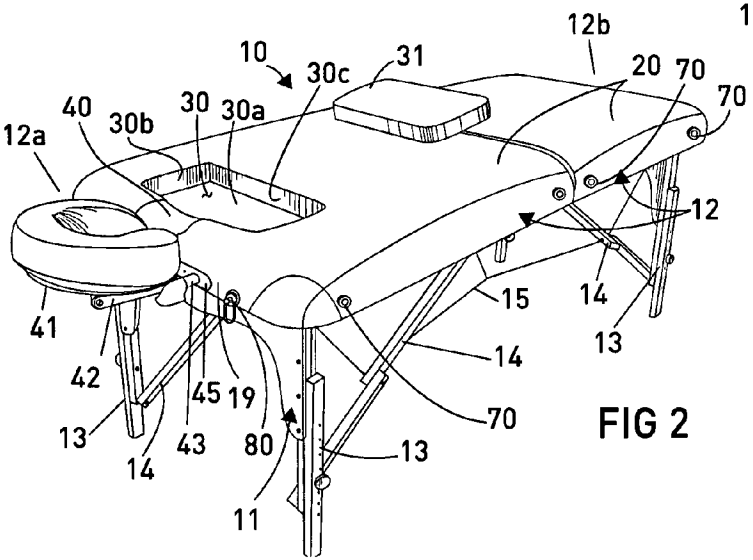
FIG. 2 is an enlarged perspective view of the massage table of FIG. 1, shown from the right side and being illustrated with the removable insert removed and shown resting on the top surface of the table.
Figure 4:
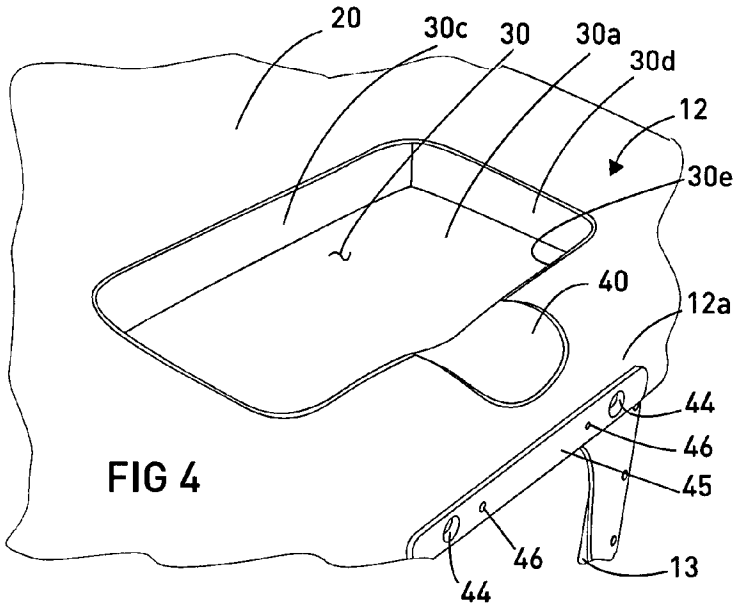
FIG. 4 is a front perspective view of the massage table of FIG. 1, as viewed from the left front, taken above the table, with the remainder of the massage table being shown in partial view.
Figure 6:
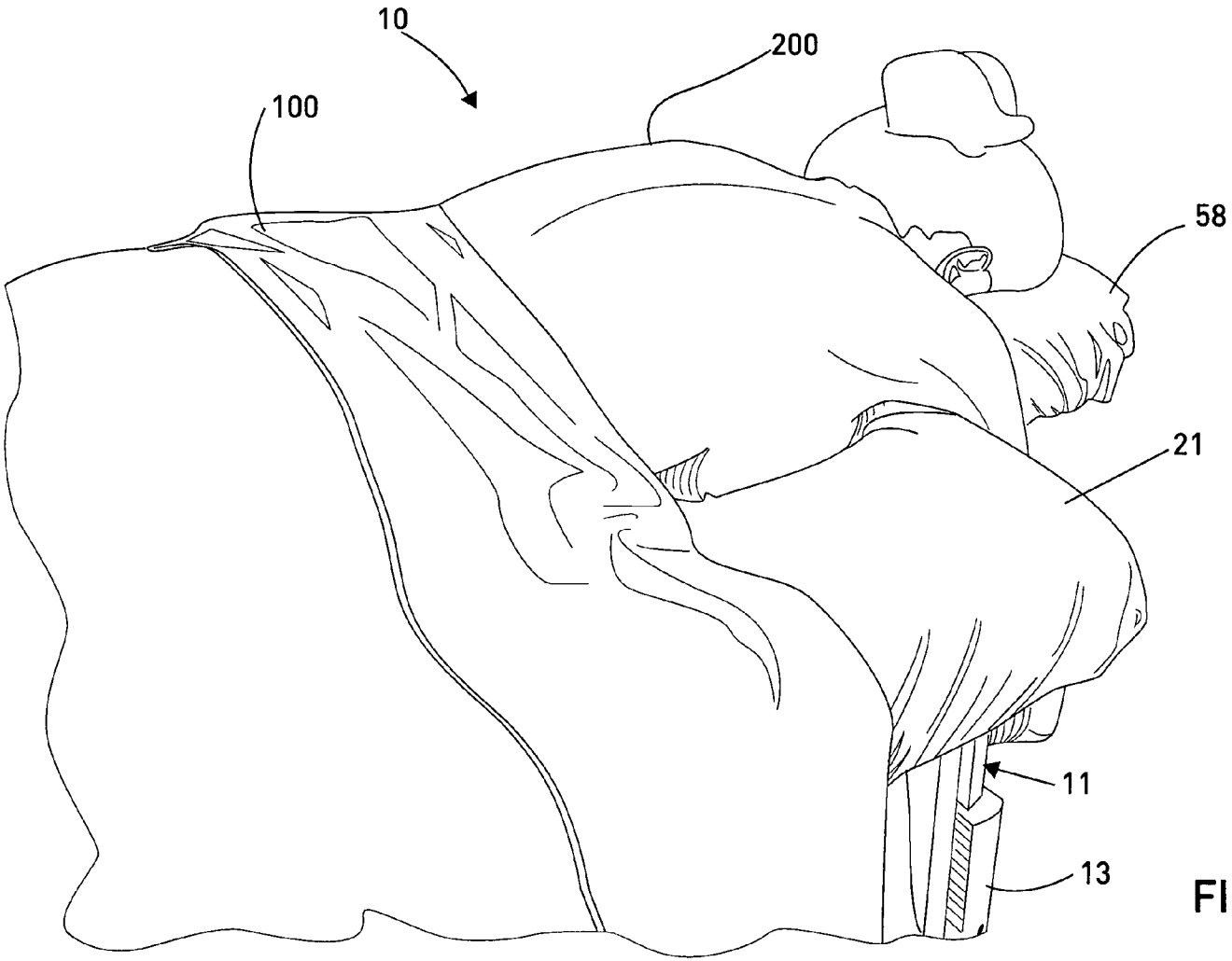
FIG. 6 is a perspective view of the table of FIG. 1, shown in partial view with a cover covering the table surface and the head rest, and being illustrated in an environment where the table is in use with a female person resting on the table.

The massage table 10 preferably has one or more comfort features. As illustrated in FIG. 2, the massage table includes a recess 30, which is formed in the surface 12 of the massage table 10. The recess 30, preferably is disposed in the padding (not shown) of the top surface 12, and is covered with the surface cover 20. The removable cover 21 may also cover the recess 30. The recess 30 preferably is provided at a location on the table 10 that will align with the position of the breasts of a female 200 when she is lying face down on the table 10, as illustrated in FIG. 6. Alternately, the recess 30 may be referred to as the breast recess. Preferably, the breast recess 30 includes a supportive configuration with a recess surface 30*a* on which the breasts of a female user may rest. The sides 30*b*, 30*c*, 30*d* and 30*e* of the breast recess 30 (FIGS. 3 and 4) further may provide support. The breast recess 30, according to preferred embodiments, is designed to provide relief from pressure when a woman is lying face down on the table (as in FIG. 6), and, in particular, when pressure is being applied to the woman's back (e.g., by a masseuse or chiropractor).

A removable recess insert 31 is provided to cover the recess 30 when the recess 30 is not required so that the table surface 12 may be generally even and smooth. For example, when a person is lying on his or her back, or when a male is using the table 10, the recess insert 31 may be installed in place. A cover member (not shown) also may be provided to cover the recess insert 31, so that the recess insert 31 may be removed and replaced without the need to remove the removable cover 21. The recess insert 31 may be constructed from foam and include a covering, such as for example a cover that matches the surface cover 20 of the table top 12.

The recess inserts 31 may then cleaned or sanitized for reuse. The recess insert 31 also may have a removable cover, similar to the removable cover 21 shown covering the top surface 12 of the table 10, which may be disposable or cleaned and reused. According to a preferred embodiment, the recess insert 31 may be configured as a panel to fill or substantially fill the recess 30 when the insert 31 is installed in the recess 30. Preferably, the recess insert 31 is configured so that when it is installed within the recess 30 it forms with the table surface 12 the surface of the table 10, and preferably provides a uniform, flat or substantially flat, table surface. For example, the recess insert 31 may snugly fit within the recess 30 and fills the space of the recess 30 from the bottom of the recess 30 (e.g., from the recess surface 30*a*) to the top of the recess 30 where the recess 30 meets the top of the table surface 12. Preferably, the recess 30 has a dimension that, when the recess insert 31 is inserted into the recess 30, allows the table surface 12 and recess insert 31 to form or approximate a flat table surface (e.g., one without a recess). According to a preferred embodiment, the insert 31 may be constructed so that when it is installed in the recess 30, the insert 31 fits snugly against the sides 30*b*, 30*c*, 30*d* and 30*e* of the breast recess 30.

According to a preferred embodiment, the table top surface 12 that is shown on the frame 11 preferably is constructed from a suitable density foam material, such as for example, a medium or high density upholstery foam, so that the recess 31 and table surface 12 may support the weight of an individual on the table. The surface cover 20 preferably covers the foam.

Figure 5:
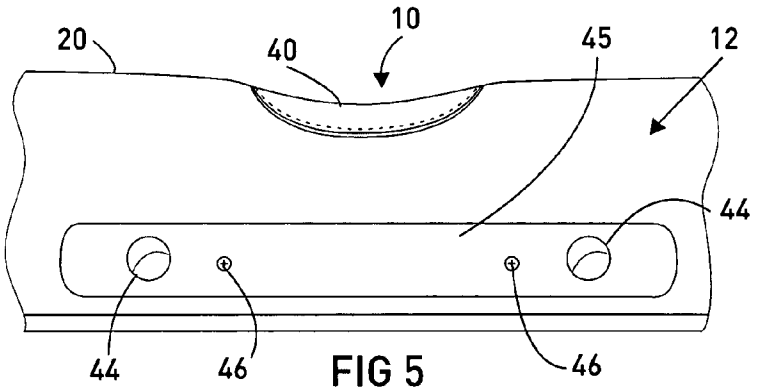
FIG. 5 is a front elevation view of the front of the table, showing the table in partial view, and being enlarged to show the head rest attachment mechanism and the neck recess.
Figure 3:
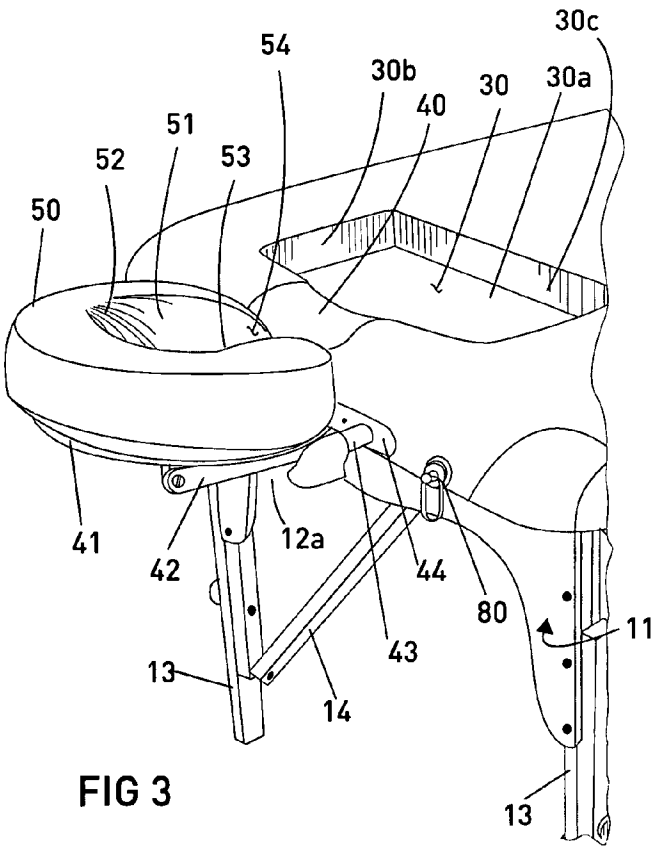
FIG. 3 is a perspective view showing the front right end of the massage table of FIG. 1, illustrated to show the removable head rest, with the remainder of the massage table being shown in partial view.

The recess 30 preferably is configured with at least one side that preferably includes or joins with an additional comfort feature comprising a neck recess 40. The neck recess 40 is shown having a curved configuration that spans from the recess 30 to the front 19 of the table 10. A removable head rest 50 is provided and preferably is configured so that a user's head may be supported, while the user's face, or part of a user's head may be free of contact with a support. The head rest 50 includes a mounting mechanism for attaching the head rest 50 on the table 10. Preferably, the head rest 50 includes a supporting structure 41 with a connector 42 and mounting elements, such as, for example, the posts 43 which are designed to pass through the apertures 44 provided on the mounting bar 45 (FIG. 5). Referring to FIG. 5, the mounting bar 45 includes apertures 44 through which the posts 43 of the head rest 50 may be inserted. The mounting bar 45 preferably is secured to the table surface 12 with fasteners, such as the screws 46. The head rest 50, according to a preferred configuration, is constructed from a pad (e.g., foam) that is covered with a surface material, such as, for example, the material that is used for the surface cover 20 of the table top 12 and the recess insert 31. The head rest 50 preferably has sloped wall portions 51, 52, 53, for facilitating comfort when a person rests his or her head on the head rest 50. The head rest 50 preferably includes an opening 54 for a person's face. The opening 54 preferably is provided near the neck recess 40. As shown in FIG. 6, a removable cover 58 may be provided to cover the head rest 50 and may be constructed of the same material from which the removable table top cover 21 is made, such as, for example, a disposable plastic or paper material, or a washable cotton, polyester or other fabric. A recess insert cover (not shown) also may be provided and may be constructed from similar materials. A blanket 100 also is shown in FIG. 6 and may be separately provided, or, optionally, may be provided to match one or more, or all of the cover 21, recess cover or head rest cover 58.

Preferably, according to the preferred embodiment shown in FIGS. 1-6, the massage table 10 includes a number of comfort features, including the recess 30, the removable recess insert 31, the neck recess 40 and the head rest 50. The recess insert 31, when removed from the recess, may be used additionally as a support or cushion for legs, back, or other part of a person while using the table 10.

As illustrated in FIG. 2, a plurality of support elements 70 are provided on the side portion 71 of the top surface 12 for facilitating standing of the table 10 when it is in its folded position. The support elements 70 preferably are configured and arranged to support the weight of the folded table 10, and are provided on the opposite side of the table 10 as the handles 16 (FIG. 1). Latching elements 80 preferably are also provided to latch the table together in a folded position for transport or storage. Mating latching elements also may be provided at the back of the table 10 for connecting with the latching elements 80 shown on the table front 19.

Although the table 10 is described herein as a massage table, tables constructed according to my invention may be used as a chiropractic table. According to alternate embodiments, the table 10 may be configured without a hinge and, according to some embodiments may be non-foldable. The tables described and shown herein may be used in connection with massage therapy as well as chiropractic therapy, and other suitable uses.

Figure 7:
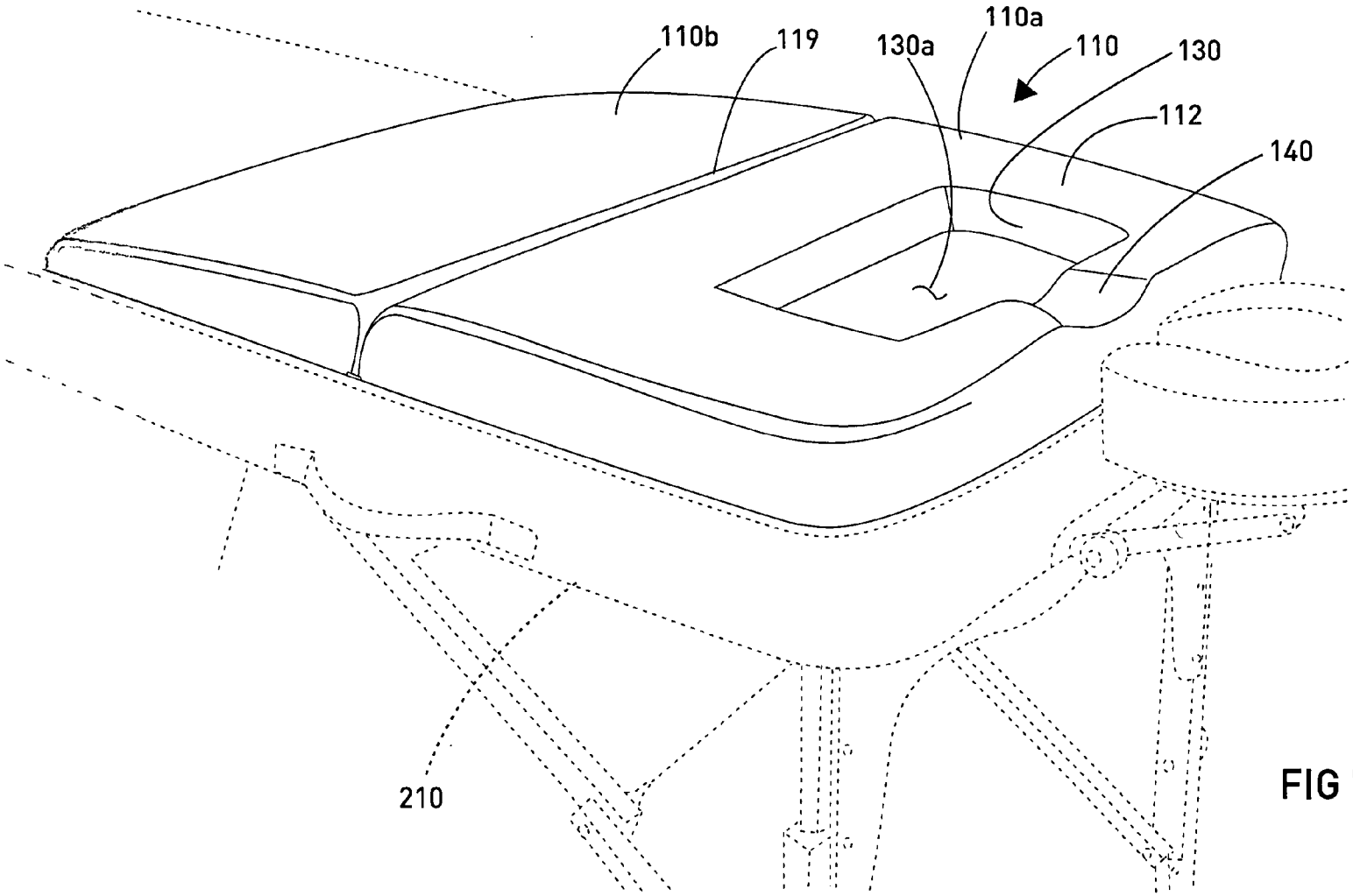
FIG. 7 is a perspective view an alternate embodiment of a massage table apparatus that is designed to be placed on a frame or table top, the massage table apparatus being illustrated in an environment with the supporting structure shown in broken line representation.
Figure 9:
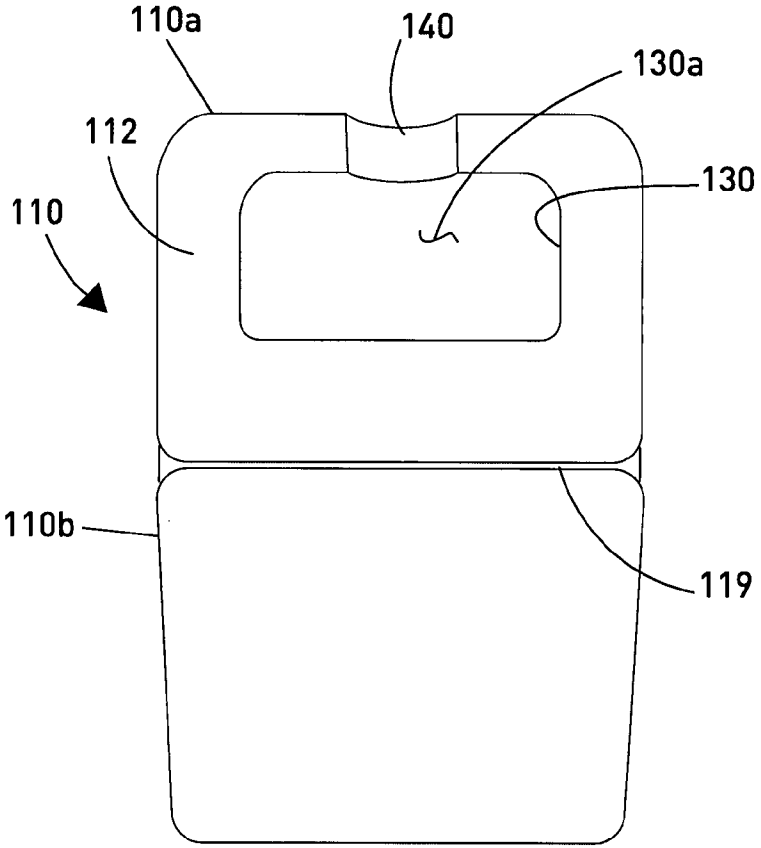
FIG. 9 is a top plan view of the apparatus of FIG. 7.
Figure 8:
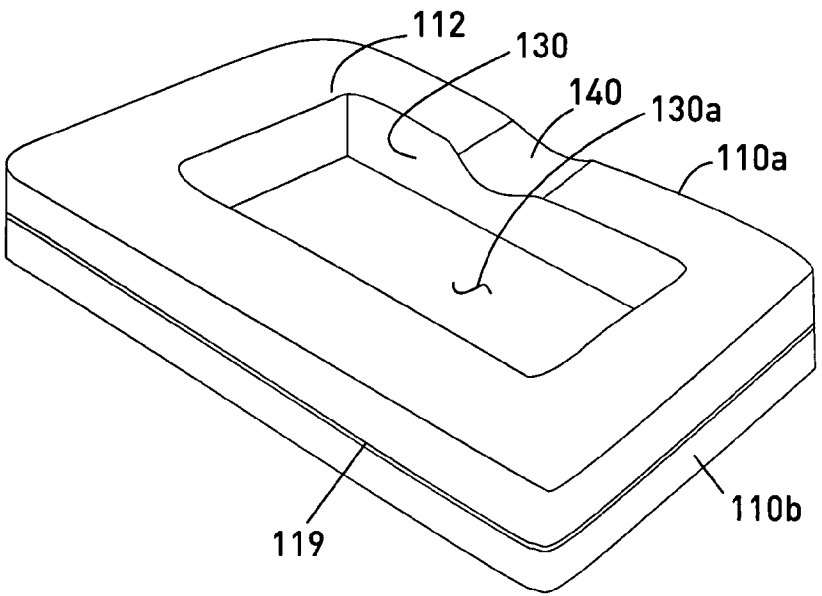
FIG. 8 is a perspective view of the massage table apparatus of FIG. 7, shown in a folded condition.

FIGS. 7, 8 and 9 illustrate an alternate embodiment of a massage table apparatus 110 that is designed to be placed on a supporting structure 210, which may, for example, be a frame or table surface. The table apparatus 110 has a body portion 112 and preferably has a comfort features, including the recess 130, illustrated as a rectangular opening 130*a* in the body portion 112. Preferably, a neck recess 140 also is provided. The recess 130 preferably is constructed so that when the table apparatus 110 is placed on a surface, such as a table surface 210, the recess 130 forms an enclosure with the table surface 210. According to a preferred construction, the table apparatus 110 includes sections that may be folded for ease of storage and transport. FIG. 8 illustrates a preferred condition of the table apparatus 110 shown folded. Two portions 110*a* and 110*b* are provided and are hingeably connected along a fold zone 119. The table apparatus 110 may be constructed from a material, such as leather, vinyl or other suitable natural, synthetic, or blended material that may be cleaned with soap and water, or other type of suitable disinfectant.

Though preferred embodiments are set forth in the above summary, detailed description and the appended claims, numerous modifications and variations of the structure of this invention, all within the scope of the invention, also may be made by those of skill in the art all within the spirit and scope of my invention. Though the massage table embodiments are shown and described in connection with a woman's breasts, the recess may be used to accommodate men, and also provide comfort for men's breasts, or situations where an object, such as, for example, a pacemaker which is generally located on the chest area, needs to be accommodated. The descriptions herein are illustrative only of the principles of the invention and are not limiting thereof.

What is claimed is:

1. A massage table comprising:

a) a supporting frame;

b) a surface supported on said frame; said surface including a top face;

c) wherein at least one or more comfort features are provided;

d) wherein said frame is foldable;

e) wherein at least one comfort feature comprises at least one first recess provided in an area of the table for accommodating the anatomy of a person;

f) wherein said first recess includes a removable insert which when installed forms part of the surface, and, which when removed, exposes said at least one first recess in said surface;

g) the table further including a removable head rest;

h) wherein said head rest has a space for accommodating a portion of said person's head when said person is lying in a face down position;

i) wherein said head rest has attachment means for attachment of the head rest to said frame;

j) the device further including an arcuately shaped neck recess at at least one end of said table;

k) wherein said at least one first recess comprises a breast recess for accommodating the breast of a person;

l) wherein the table includes at least one handle; and wherein said at least one first recess and said neck recess share a common recessed edge relative to said top face.

2. The massage table of claim 1, wherein said neck recess and said at least one first recess are continuously provided so that said at least one first recess is integrally connected to said neck recess, wherein both said first recess and said neck recess are recessed relative to the top face of said surface.

3. A massage table apparatus with a comfort feature comprising:

a pad having a surface, being foldable and having a front portion and a rear portion; said pad having at least one comfort feature comprising at least one first recess provided in said front portion of said surface for accommodating the anatomy of a person, and an arcuately shaped neck recess disposed forward of said first recess at the front portion of said table; wherein said neck recess communicates with said first recess;

wherein said surface includes a top face, and wherein said at least one first recess and said neck recess share a common recessed edge relative to said top face.

4. The massage table apparatus of claim 3, wherein said neck recess and said at least one first recess are continuously provided so that said at least one first recess is integrally connected to said neck recess, wherein both said first recess and said neck recess are recessed relative to the top face of said surface.

5. A massage table comprising:

a) a supporting frame;

b) a surface supported on said frame, said surface being foldable and having a front portion and a rear portion said surface including a top face;

c) wherein one or more comfort features are provided;

said one or more comfort features including at least one first recess provided in said front portion of said surface for accommodating the anatomy of a person, a removable head rest provided at the end of said front portion, and an arcuately shaped neck recess disposed forward of said first recess at at least one end of said table;

where said neck recess communicates with said first recess; and wherein said at least one first recess and said neck recess share a common recessed edge relative to said top face.

6. The massage table of claim 5, wherein said frame is foldable.

7. The massage table of claim 5, wherein said at least one first recess includes a removable insert which when installed forms part of the surface, and, which when removed, exposes said at least one first recess in said surface.

8. The massage table of claim 7, wherein said at least one first recess comprises a breast recess for accommodating a woman's breasts.

9. The massage table of claim 8, wherein said removable insert comprises a pad used for supporting the body of a person.

10. The massage table of claim 9, further including at least one handle.

11. The massage table of claim 5, wherein said head rest has a space for accommodating a portion of a user's head when the user is lying in a face down position.

12. The massage table of claim 11, wherein said head rest has attachment means for attachment of the head rest to said frame.

13. The massage table of claim 5, wherein said at least one first recess is provided at a location in said front portion of said surface for accommodating the anatomy of a woman.

14. The massage table of claim 13, wherein said at least one first recess includes a removable insert which when installed forms part of the surface and, which when removed, exposes said at least one first recess in said surface.

15. The massage table of claim 5, wherein said neck recess and said at least one first recess are continuously provided so that said at least one first recess is integrally connected to said neck recess, wherein both said first recess and said neck recess are recessed relative to the top face of said surface.

* * * * *

UNITED STATES PATENT AND TRADEMARK OFFICE

CERTIFICATE OF CORRECTION

PATENT NO. : 8,555,437 B2
APPLICATION NO. : 12/806914
DATED : October 15, 2013
INVENTOR(S) : Gorovitz et al.

It is certified that error appears in the above-identified patent and that said Letters Patent is hereby corrected as shown below:

Title Page, Item (76) Inventor, should read

--(76) Inventors: Marvin Gorovitz, Philadelphia, PA (US); Bronwen DuPertuis, Conshohocken, PA (US)--.

Signed and Sealed this
Eighth Day of December, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,555,437 B2
APPLICATION NO. : 12/806914
DATED : October 15, 2013
INVENTOR(S) : Gorovitz et al.

It is certified that error appears in the above-identified patent and that said Letters Patent is hereby corrected as shown below:

Title Page, Item (12) should read GOROVITZ, et al.

Title Page, Item (76) Inventor, should read

--(76) Inventors: Marvin Gorovitz, Philadelphia, PA (US); Bronwen DuPertuis, Conshohocken, PA (US)--.

This certificate supersedes the Certificate of Correction issued December 8, 2015.

Signed and Sealed this
Fifth Day of January, 2016

Michelle K. Lee

Michelle K. Lee
*Director of the United States Patent and Trademark Office*